US005613674A

United States Patent [19]

Golicz et al.

[11] Patent Number: 5,613,674

[45] Date of Patent: Mar. 25, 1997

[54] PAPER EDGE JUSTIFYING CONVEYOR

[75] Inventors: Stefan G. Golicz, Essex; Roman M. Golicz, Clinton, both of Conn.

[73] Assignee: Documotion, Inc., Old Saybrook, Conn.

[21] Appl. No.: 334,195

[22] Filed: Nov. 4, 1994

[51] Int. Cl.[6] ..... B65H 9/16

[52] U.S. Cl. ..... 271/250; 271/251

[58] Field of Search ..... 271/251, 250, 271/248

[56] References Cited

U.S. PATENT DOCUMENTS 3,595,565 7/1971 Bergland ..... 271/251

4,147,339 4/1979 Shiina ..... 271/251 X

*Primary Examiner*—David H. Bollinger

*Attorney, Agent, or Firm*—Chilton, Alix & Van Kirk

[57] ABSTRACT

A paper edge justifying conveyor has a first roller and a second roller arranged in a generally parallel position. A guide rail positioned in a position perpendicular to said rollers provides documents with edge justification. An elastomeric band around the rollers having at least one twist on a top surface provides for edge justification of documents against the guide rail.

3 Claims, 15 Drawing Sheets

PAPER EDGE JUSTIFYING CONVEYOR

BACKGROUND OF THE INVENTION

Field of the Invention

The present invention relates to the processing of printed documents and, particularly, to document conveyors for a document processing system having a single paper path Accordingly, the general objects of the present invention are to provide novel and improved methods and apparatus of such character.

SUMMARY OF THE INVENTION

While not limited thereto in its utility, the present invention is designed for use with a printer which enables the addition of indicia, in selected colors, to printed documents exiting a high speed electrographic or xerographic printer, i.e., a high volume printer with accent color capability.

The present invention overcomes the deficiencies and disadvantages of the prior art by providing a justification module which comprises a unique conveyor which transports and justifies, either to the left or to the right, sheet material of various size, thickness, texture, porosity, etc. This edge justifying transport conveyor employs at least a first endless belt which is tensioned around two rollers and twisted so that the upper, i.e., outer, face of the belt traveling on one roller becomes the inside face of the belt at the other roller. This arrangement will cause objects delivered to the belt to be moved laterally by a distance of up to the thickness of the belt multiplied by the number of twists between the rollers.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENT

Figure 1:
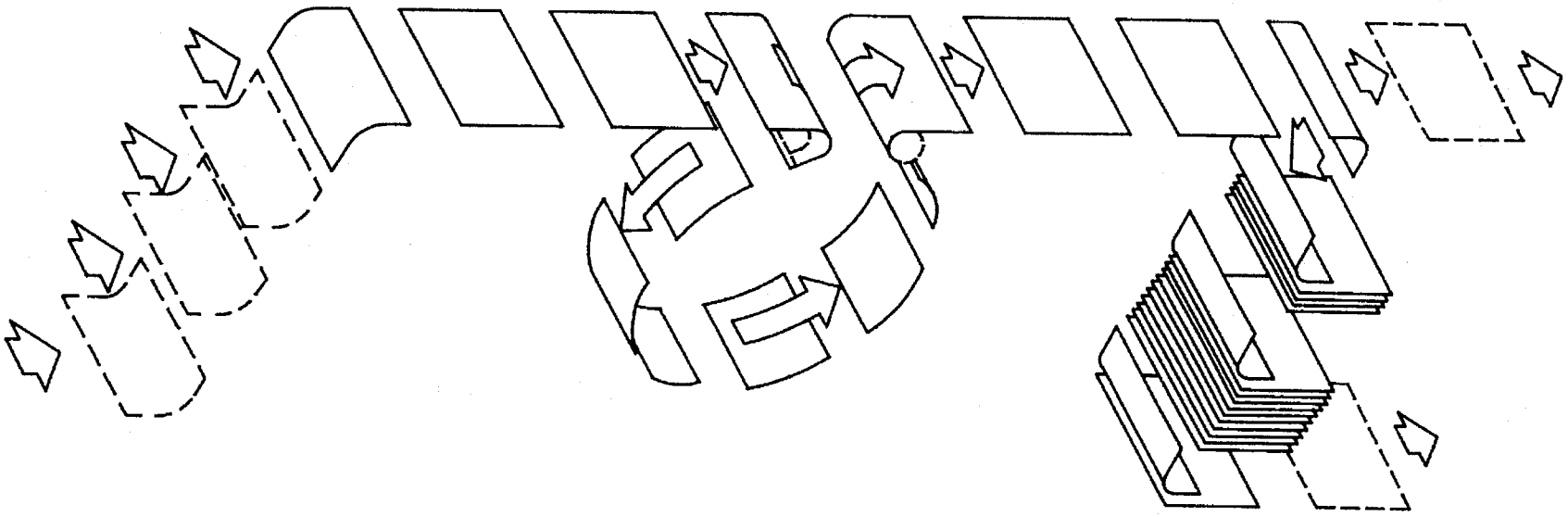
FIG. 1 is a schematic, perspective view which represents the movement of documents being processed in accordance with the present invention.
Figure 2:
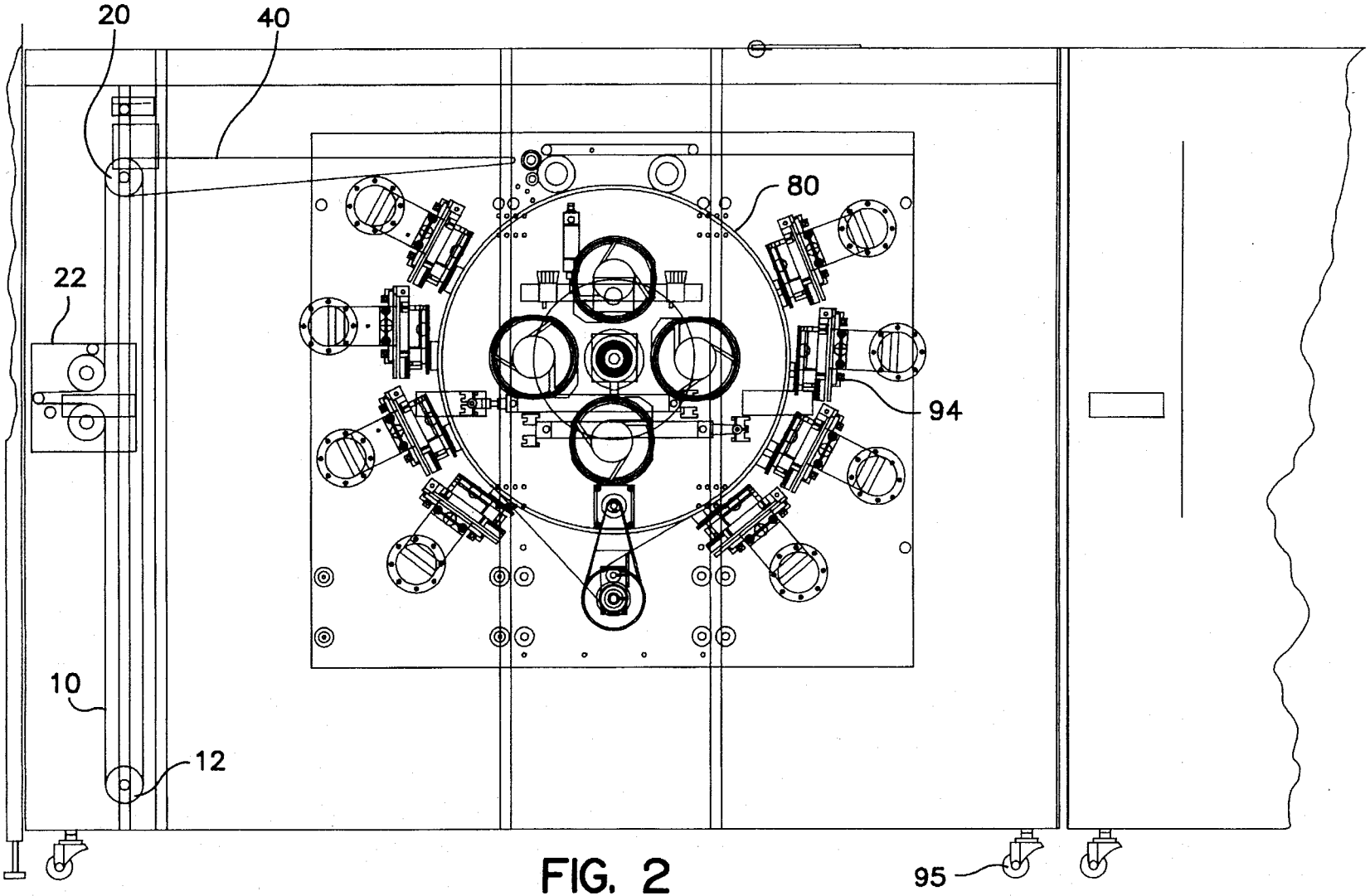
FIG. 2 is a schematic, partial side elevation view of an apparatus utilizing the invention.
Figure 5:
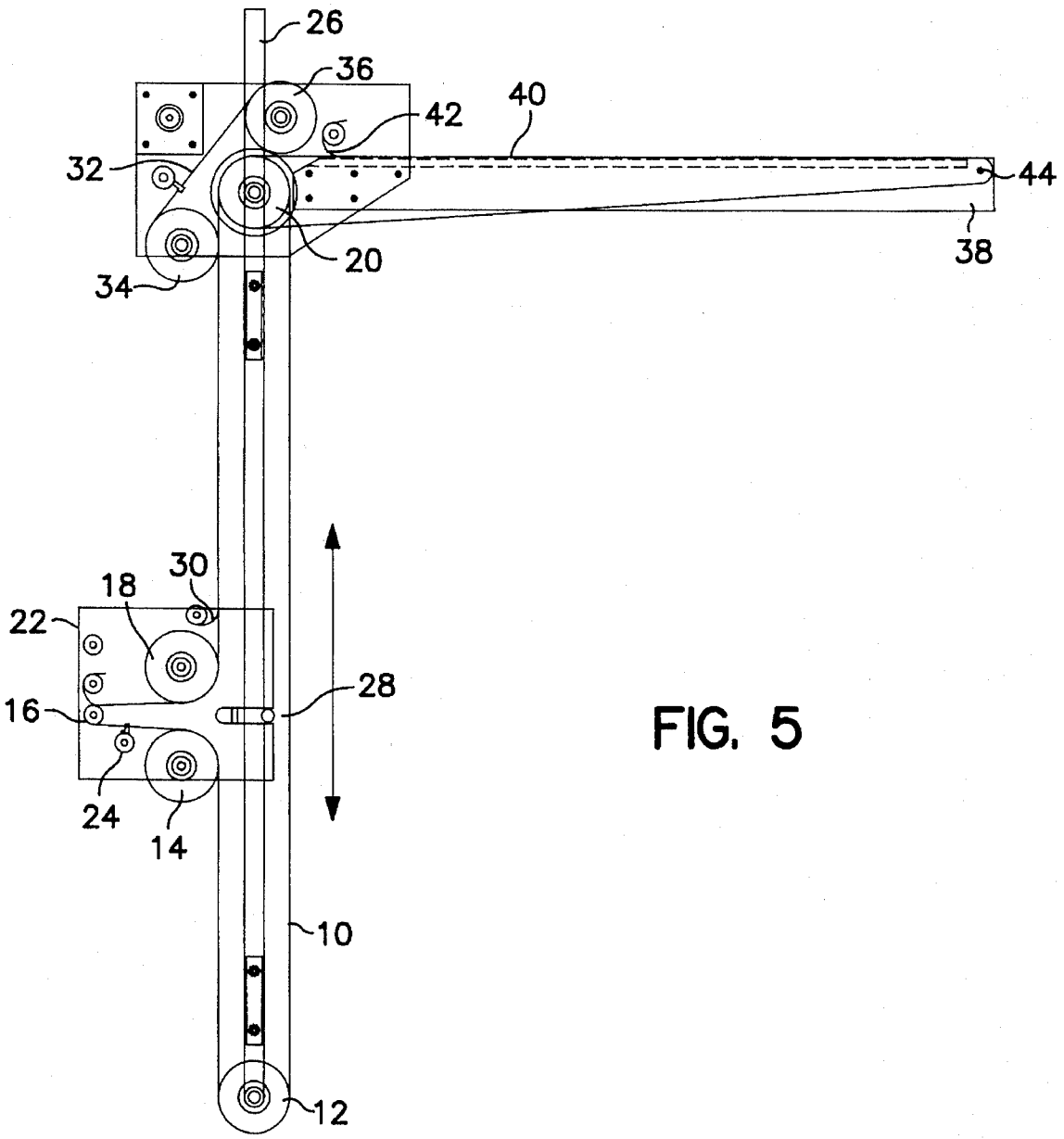
FIG. 5 is an enlarged, side-elevation view of the infeed and justification modules of the apparatus depicted in FIG. 2.

With reference now to the drawings, and particularly FIGS. 1 and 5, the infeed module portion of the disclosed embodiment is designed to interface with, or otherwise be directly coupled to, the discharge port of an existing high speed, black toner printer. Accordingly, the level at which the incoming printed documents are received may be adjusted vertically to permit interfacing of the invention with various hosts. The infeed module is also designed to accept incoming material regardless of form, i.e., the present invention may be employed to process material in sheet or more complex forms such as envelopes, pockets, etc. The incoming documents are received on the upper side of a horizontal run of a conveyor belt 10. Belt 10, as may be seen from FIGS. 2 and 5, is continuous and passes about rollers 12, 14, 16, 18 and 20. The axles which support rollers 12 and 20 are fixed in position on the machine frame while rollers 14, 16 and 18 are mounted on a vertically adjustable platform 22 which also includes a belt guide 24. Platform 22 may be slid along a vertical frame member 26 and locked at the desired vertical level by means of a clamp collar 28. Referring jointly to FIGS. 1 and 5, a document received on belt 10 will, while travelling on the belt, pass under roller 16 where its direction of motion is changed, i.e., the document travel path will change from horizontal to vertical. The document then moves upwardly and, during such movement is held against belt 10 by spring-loaded fingers such as the finger indicated schematically at 30. When the document reaches the desired height as defined by the outer diameter of roller 20, its direction is again changed such that it resumes movement in a generally horizontal direction, albeit at a higher level than the initial infeed level. The change of direction at the top of the infeed module, in the disclosed embodiment, is accomplished by causing the document to be transported around roller 20 while being sandwiched between a further continuous belt 32 which passes around rollers 34 and 36. The change in direction must be accomplished in such a manner, i.e., the diameter of roller 20 must be sufficiently great, to ensure that a permanent curl will not be imparted to the document. The infeed module conveyor belt 10 and belt 32 will typically be comprised of plural parallel belts.

Documents discharged from the infeed module are received by a justification module. The justification module, which in part straddles the primary processing module, ensures that one edge the incoming document is in contact with a linear guide rail 38 which extends in the direction of document travel. This document justification is necessary to ensure precise positioning of the document. As will be obvious, since the second and further colors are to be added to a document which has already been printed, the document must be positioned such that the areas where the color printing is to be added will be located with exactness. In accordance with the disclosed embodiment of the invention, the justification module includes at least a first twisted elastomeric belt 40 which, at the upstream end in the direction of document motion, passes about roller 20, i.e., the belt or belts 40 of the justification module will, at roller 20, be interleaved with the individual belts defining the infeed module conveyor belt 10. Documents will be held against belt(s) 40 by means of spring fingers such as finger 42.

Figure 6A:
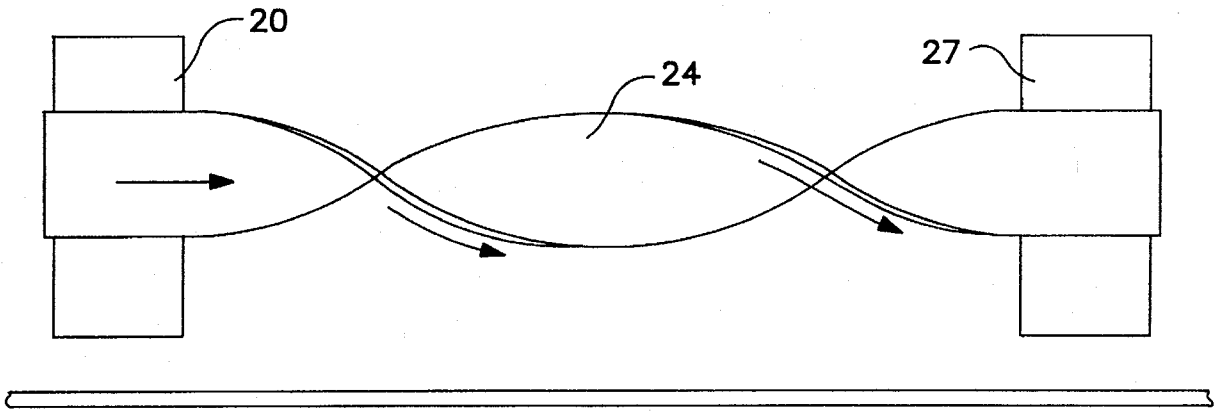
FIGS. 6A and 6B are, respectively, top and side elevation views which explain the operation of the justification module shown in FIGS. 2 and 5.
Figure 6B:
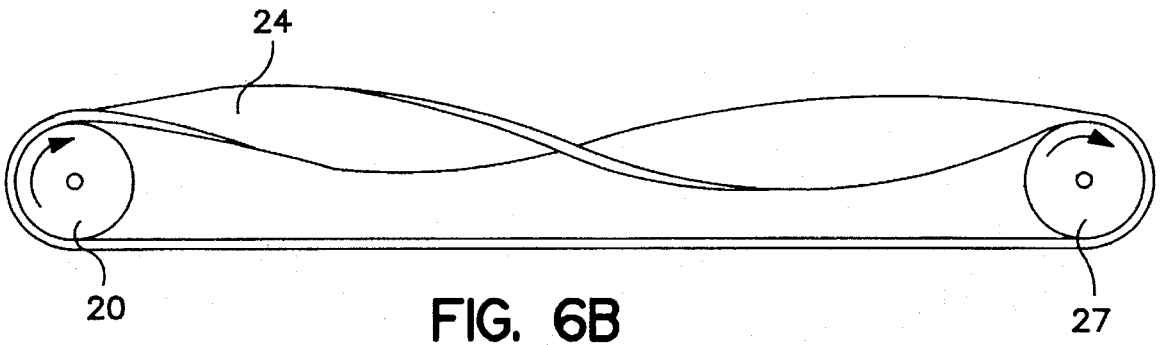

The function and construction of the justification module may be better understood by reference to FIGS. 5 and 6. The justification module is, in effect, an edge justifying transport conveyor which simultaneously transports and edge justifies, either to the left or to the right, sheets of material of various sizes, thickness, textures, porosity, etc. While the edge justifying transport conveyor is primarily used in the disclosed hybrid printing system for positioning single sheets of paper, it may be employed for folded sheets, multiple sheets, or formed sheets such as, for example, envelopes or flattened cartons. The edge justifying transport conveyor assures that the "documents" being moved will follow a linear trajectory which is referenced to one edge of the document. The edge justifying transport conveyor of the present invention is characterized by the ability to position the documents being processed as necessary for further processing with the minimum number of components and the shortest possible distance and, most importantly, while retaining constant linear speed.

The endless belt 40 may, for example, be ⅜ inches wide and is tensioned by passing around roller 20 and a downstream roller 44. The belt 40 is twisted in such a manner as to have a first face, i.e., an outside face, traveling on one roller which becomes the inside face at the other roller. Thus, the left edge of the belt at roller 20 will become the right edge of the belt at roller 44 assuming a single twist, or odd number of twists. Even numbers of twists will result in the left edge of the belt on roller 20 returning to the left edge on the belt on roller 27. The result of the twists is that the belt rotates along an axis between roller 20 and roller 27, in increments of 180 degrees depending on the number of twists. Thus, any object in contact with the left side of the belt at roller 20 will be moved ⅜ inches to the right, or against a guide rail if the initial spacing between the object and the guide rail is less than ⅜ inches, by the time it reaches roller 44. By inducing more than one twist to the belt, the side movement of the object being transported can be multiplied within the same distance of travel. If a multiplicity of such twisted belts are disposed next and parallel to each other with an identical number of twists, objects having any size/weight can be transported with simultaneous movement to either the left or the right depending on the direction of the twist given to the belts. To ensure controlled justification to one side, a guide rail or the like oriented parallel to the desired travel direction will be employed. A document coming into contact with the guide rail will be unable to move further in the transverse direction and thus will continue its forward trajectory by sliding along the guide rail. If a plurality of belts with opposite twists are placed next to each other, side-by-side, objects such as slit pages placed onto the edge justifying conveyor will either diverge or converge depending on the direction of the twist and at a rate depending on the number of twists.

Apparatus in accordance with the present invention may, but the disclosed embodiment does not, employ a buffer/feeder module which receives the edge-justified, randomly spaced incoming documents and thus acts as an extension of the justification module. The buffer/feeder module, if present, functions in conjunction with the timing module, which will be described below, to receive, store and either feed or pass through the incoming documents in the identical sequence as received. In the interest of facilitating understanding of the invention, the buffer/feeder module has not been shown.

Figure 3:
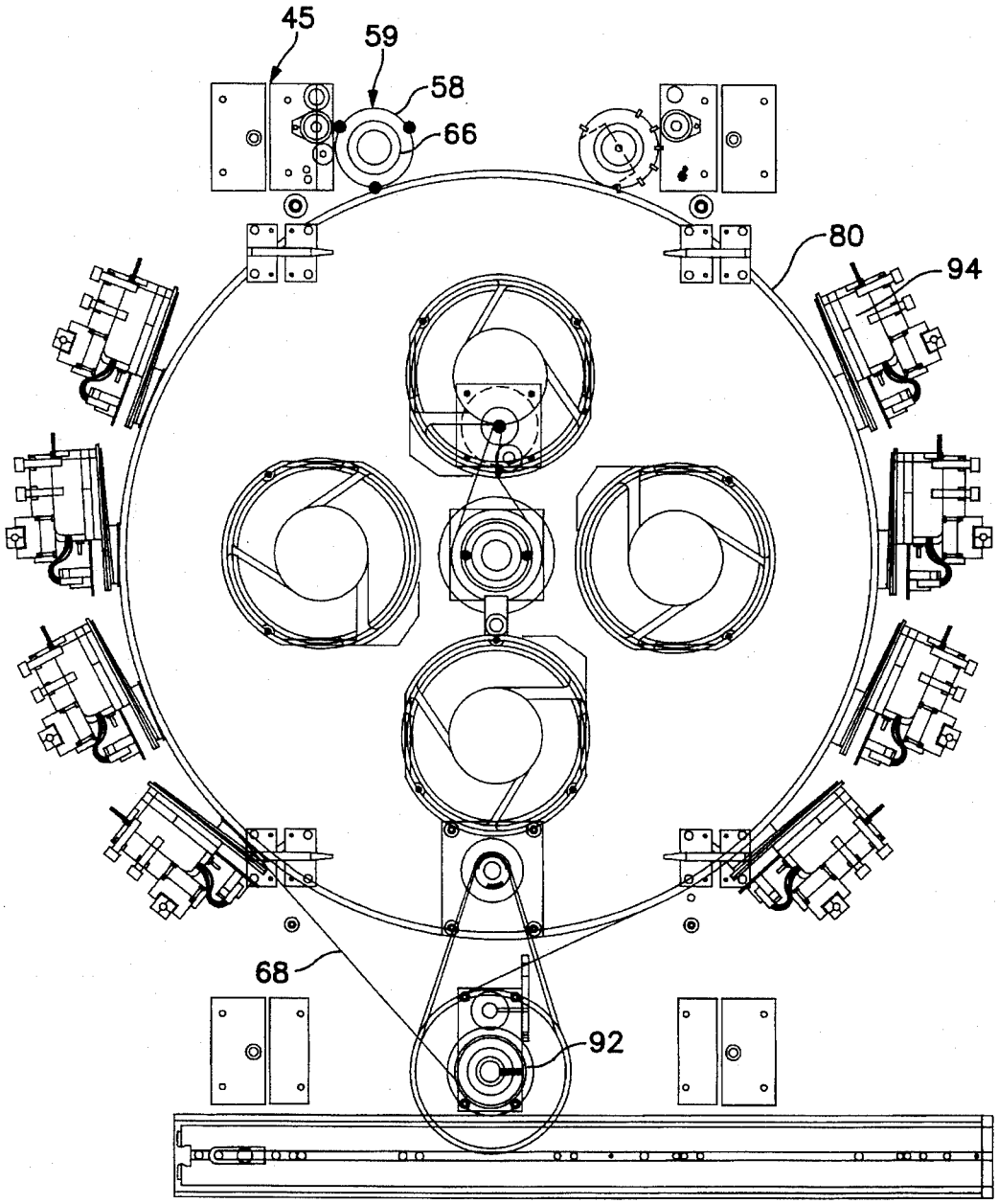
FIG. 3 is a schematic, side elevation view, on an enlarged scale, of a portion of the apparatus depicted in FIG. 2.
Figure 4:
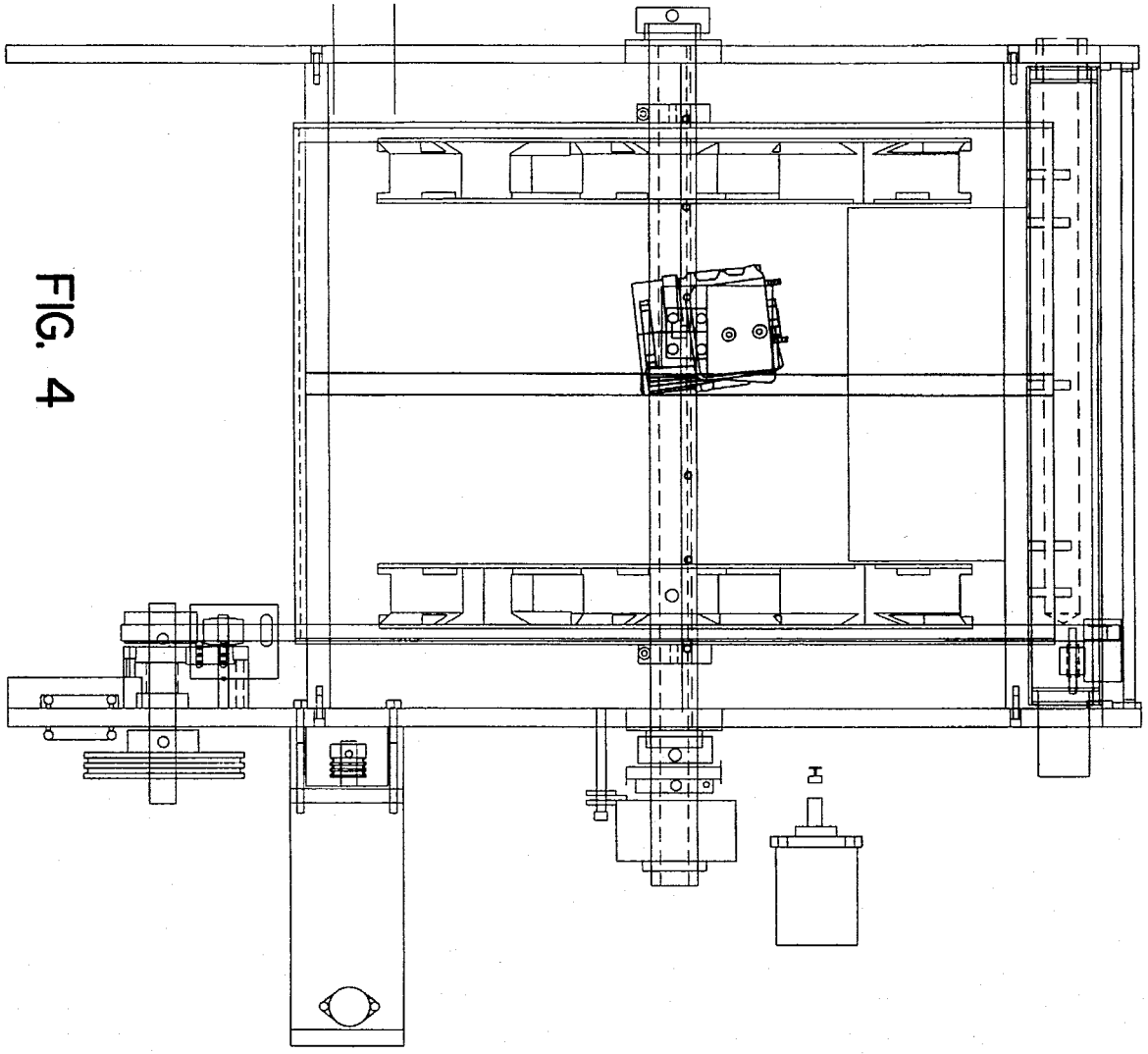
FIG. 4 is a partial top plan view of the apparatus depicted in FIG. 3.
Figure 7:
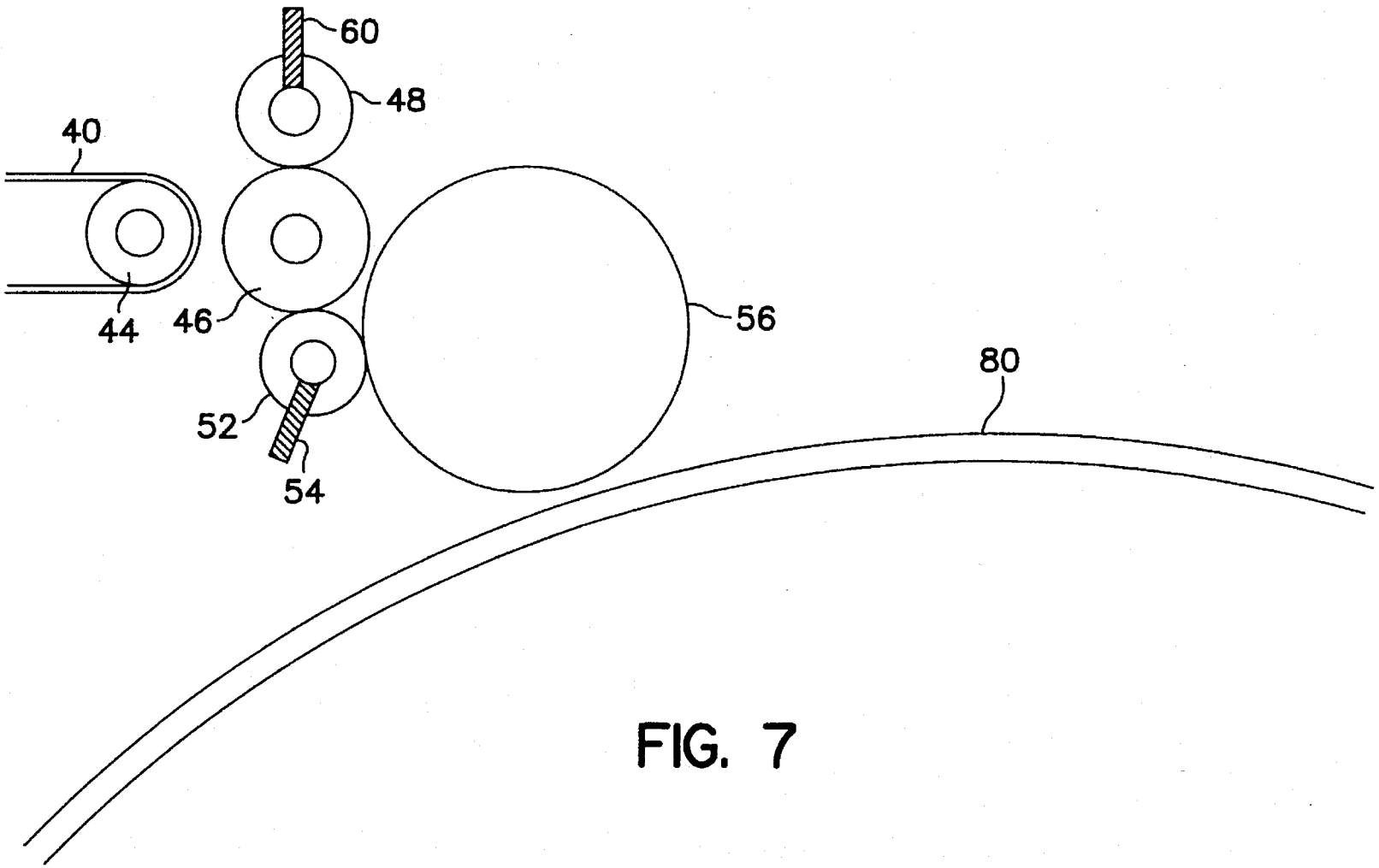
FIG. 7 is an enlarged, schematic view of the timing module of the disclosed apparatus.

The timing module, as may be seen from FIGS. 3 and 7, comprises a pair of rollers 46, 48. The function of the timing module is to receive a side justified document and to ensure that the leading edge of the document is oriented parallelly with respect to the axis of rotation of the transport drum of the processing module. The squaring and registering of the leading edge of the side justified document results from the document being stopped at the nip of rollers 46,48. The roller 46 is comprised of an elastomeric material and is activated on command, and in sychronism with the movement of the transport of the processing module, so as to release documents to the immediately downstream placement/bypass module. Roller 46 is a clutch nip roller mounted on a journaled shaft, roller 46 having an equal diameter to a drive roller 50 affixed to the same shaft. Drive roller 50 is driven by a jack roller 52 which is biased, by means of a spring 54, so as to be in contact with both of the drive roller 50 and the drive roller 56 of the porous cylinder 58 of the placement/bypass module. The idler roller 48, which is of solid construction, is resiliently biased against roller 46, by means of a spring 60. Roller 48 thus functions as a spring loaded pinch bearing. The timing module further includes infeed guides, not shown, which assure that a document is retained within the pitch point, i.e., the point of contact between the pinch bearing 48 and the cooperating elastomeric roller 46. The pressure applied to roller 48 may be adjusted to ensure that the pinch bearing will press into the elastomeric roller thus reliably defining the pinch point and permitting fine adjustment of the parallelism of the document leading edge and the processing module drum axis of rotation.

Figure 8:
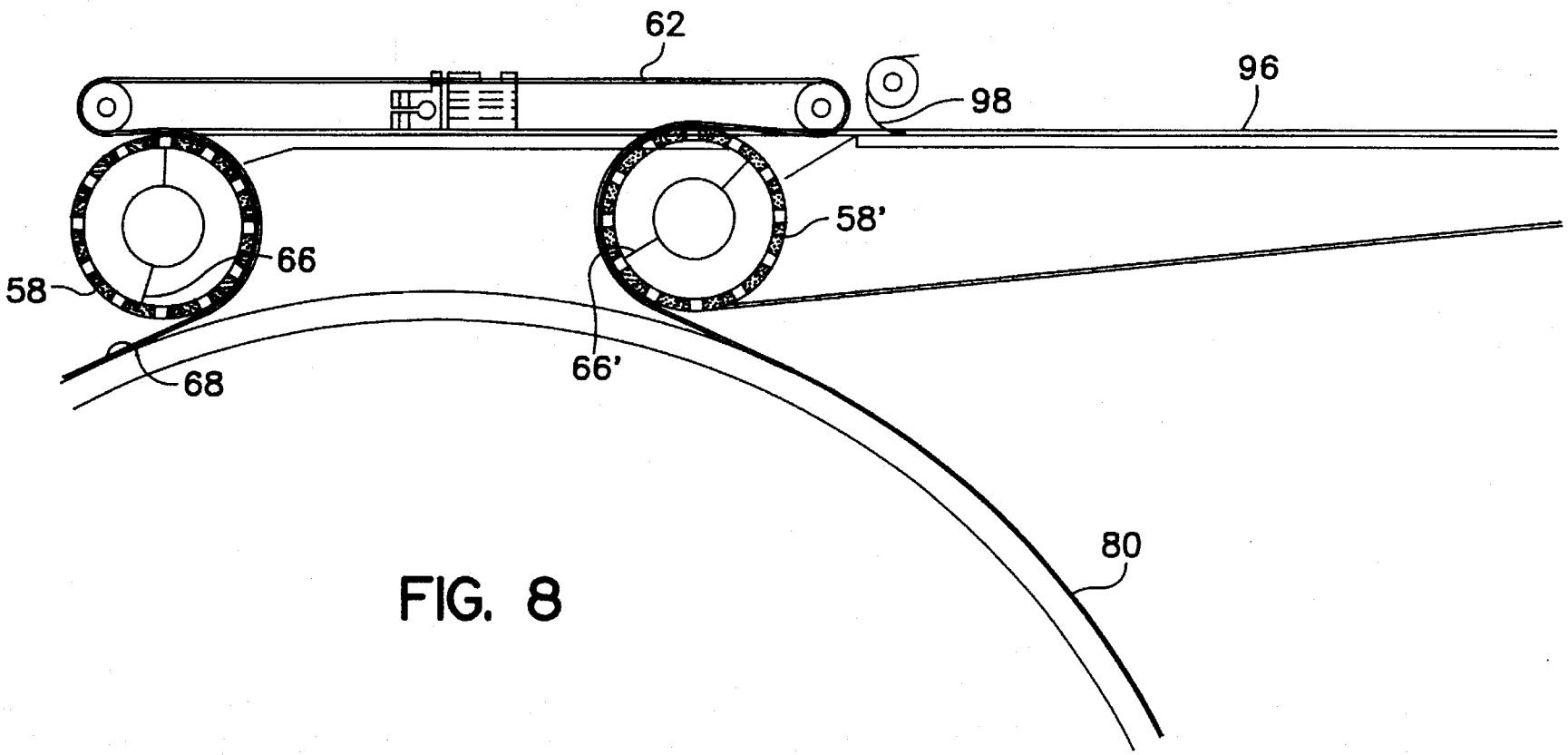
FIG. 8 is a schematic showing, in the form of a side elevation view, of the placement/bypass module of the disclosed apparatus, the placement/bypass module also being shown in FIG. 3.
Figure 10:
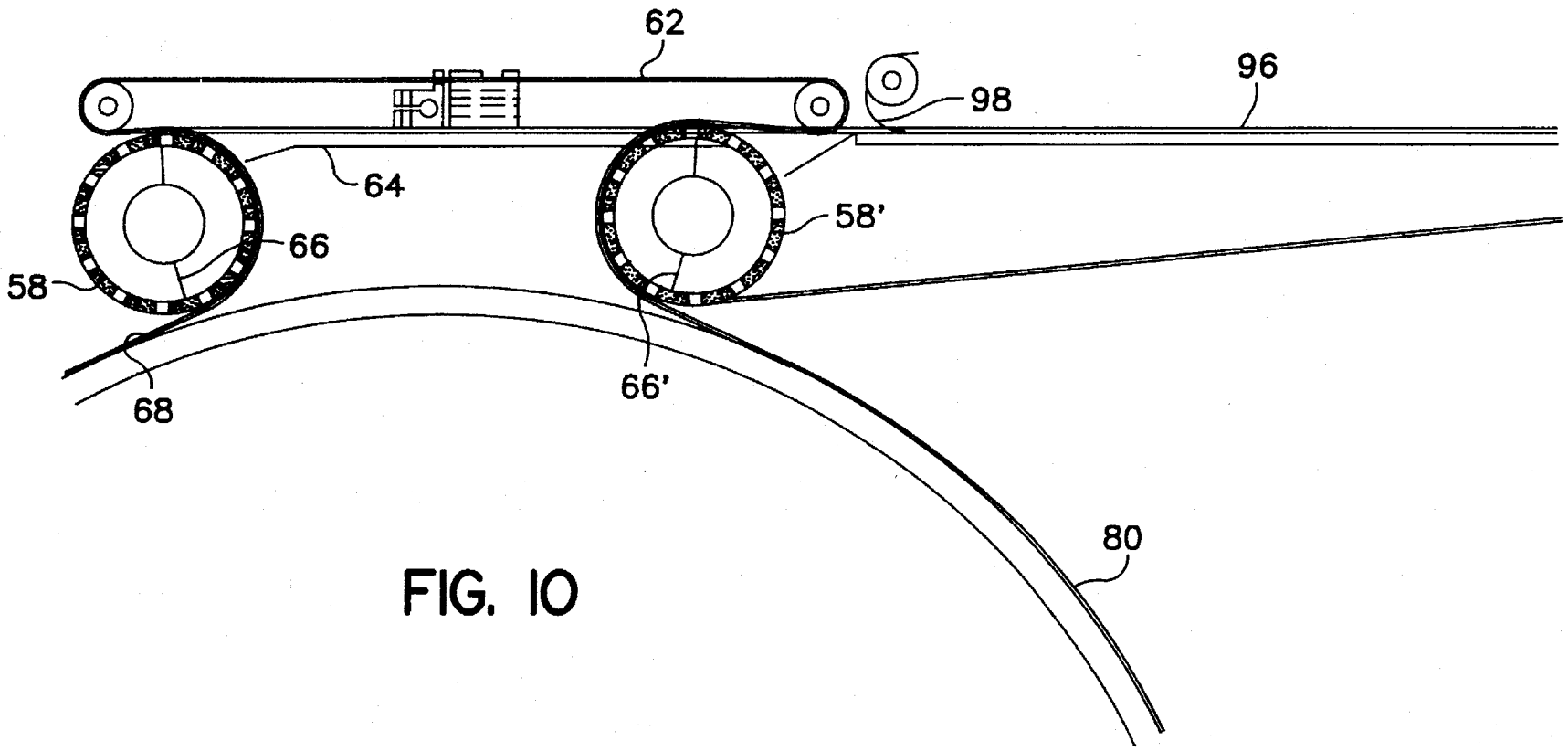
FIG. 10 is a view similar to FIG. 8 which explains operation of the vacuum roller.

The placement/bypass module is located immediately downstream of the timing module. The purpose of the placement/bypass module is to selectively change the travel path of the incoming document, which will be received in a face down orientation, from linear to rotary. Additionally, if the document is not to be passed-through without color accent printing, the placement/bypass module also positions the document, face-up, at a predetermined location on the outer, peripheral surface of the transport drum of the processing module. The conveyor which selectively allows documents to pass over the processing module, i.e., the means for transporting documents which are not to have their travel path changed from linear to rotary, is indicated in FIGS. 8 and 10 at 60. Bypassed documents, i.e., documents which are not engaged and deflected by the placement/bypass module in the manner to be described below, will pass over the vacuum roller 58 of the placement/bypass module onto a bypass skate 64. Documents fed onto skate 64 will be pinched between the skate and belt 60 and will thus be transported in the downstream direction.

Figure 9:
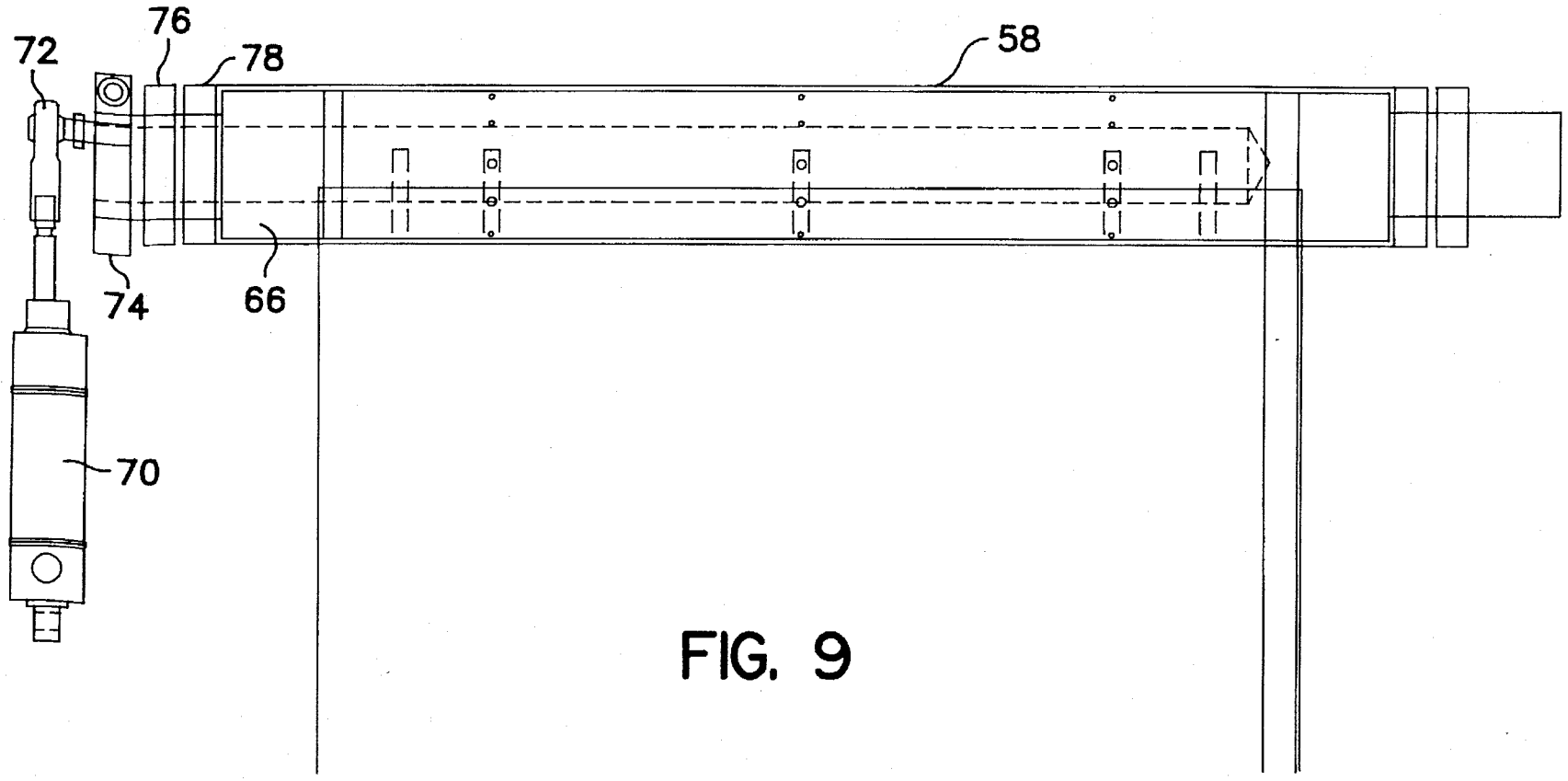
FIG. 9 is a side elevation view, taken transverse to FIG. 8, of the vacuum roller of the vacuum roller of the placement/bypass module.

The placement/bypass module, as may be seen from joint consideration of FIGS. 8–10, comprises a vacuum roller in the form of a hollow porous cylinder 58 having a diameter which is adequately large to ensure against the inducement of a permanent curl to the documents being processed. The porous cylinder 58, journaled on both ends, is freely rotatable about a central hollow mandrel 66. The gap between the outer diameter of mandrel 66 and the inner diameter of porous cylinder 58 is very small and mandrel 66 is provided with an array of ports which, in the disclosed embodiment, are located in a single quadrant. Mandrel 66 is mounted so as to be capable of rotation, either clockwise or counter-clockwise, within cylinder 55. Cylinder 58, as may be seen from FIG. 3, is driven by the same drive belt 68 which drives the processing module transport drum belt 68 actually driving roller 56. Thus cylinder 58 moves in synchronism with the processing module transport drum.

Means are provided to controllably impart rotation to mandrel 66 relative to cylinder 58. This control mechanism, upon command, can cause the mandrel 66 to rotate relative to the porous cylinder 58 through an angle of approximately 45°. Mandrel 66 is connected, by means not shown, to an adjustable vacuum source. Accordingly, a constant pressure is applied through the mandrel ports to the porous wall of the rotating cylinder 58 to induce air flow through the cylinder in the region thereof which is in registration with the ported quadrant of the mandrel. The control mechanism which may be employed to cause relative rotation between mandrel 66 and cylinder 58, to close off the vacuum in the upper quadrant of the porous roller 58, is shown in FIG. 9. This control mechanism includes a pneumatic actuator 70 having a piston rod connected to a pivot actuator 72. The pivot actuator is connected via an arm to a pivot clamp 74. Pivot clamp 74, in turn, is connected to mandrel 66. FIG. 9 also shows, at 76, the bearings on which mandrel 66 rotates and the bearings 78 on which the porous cylinder 58 rotates. When the mandrel is rotated relative to the porous outer cylinder to the position shown in FIG. 8, a received document will follow the linear path of its original trajectory and thus bypass the processing module. When, upon command which activates the pneumatic cylinder 70, the mandrel 66 is repositioned, the leading edge of the incoming document will be intercepted and drawn downwardly against the porous cylinder 58 and rotated around the cylinder until the end of the quadrant of the mandrel is reached. This operation mode is represented in FIG. 10. At this point, the document will spring away from cylinder 28 but, in the manner to be described below, will attach itself to the transport drum of the processing module.

The primary processing module includes a central transport module and multiple print heads. To first discuss the central transport module, this subsystem consists of a rotatably mounted cylinder or drum 80. Drum 80 is porous so that a document hold-down pressure differential may be created, i.e., air flow through the porous drum will result in a lower pressure on the interior than the exterior whereby incoming documents released from the placement/bypass module will be attracted to and held against the outer periphery of drum 80.

Figure 11:
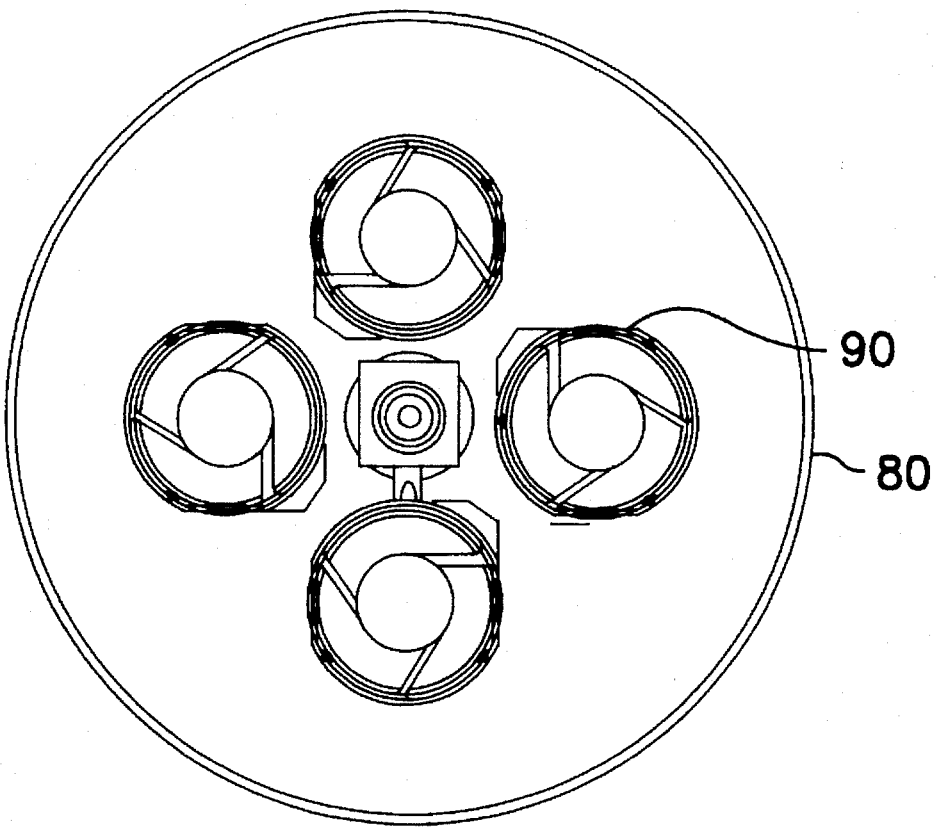
FIG. 11 is a schematic side elevation view of the drum of the transport system of the processing module of the disclosed apparatus.
Figure 12:
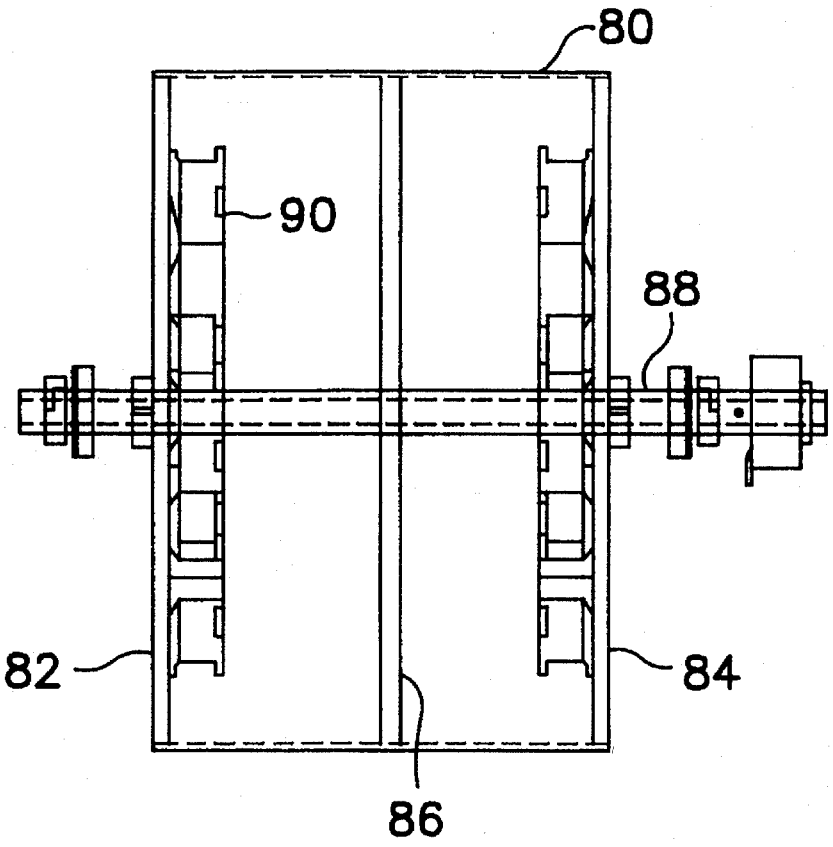
FIG. 12 is a view taken transverse to FIG. 11 showing the construction of the drum of the processing module transport.
Figure 13:
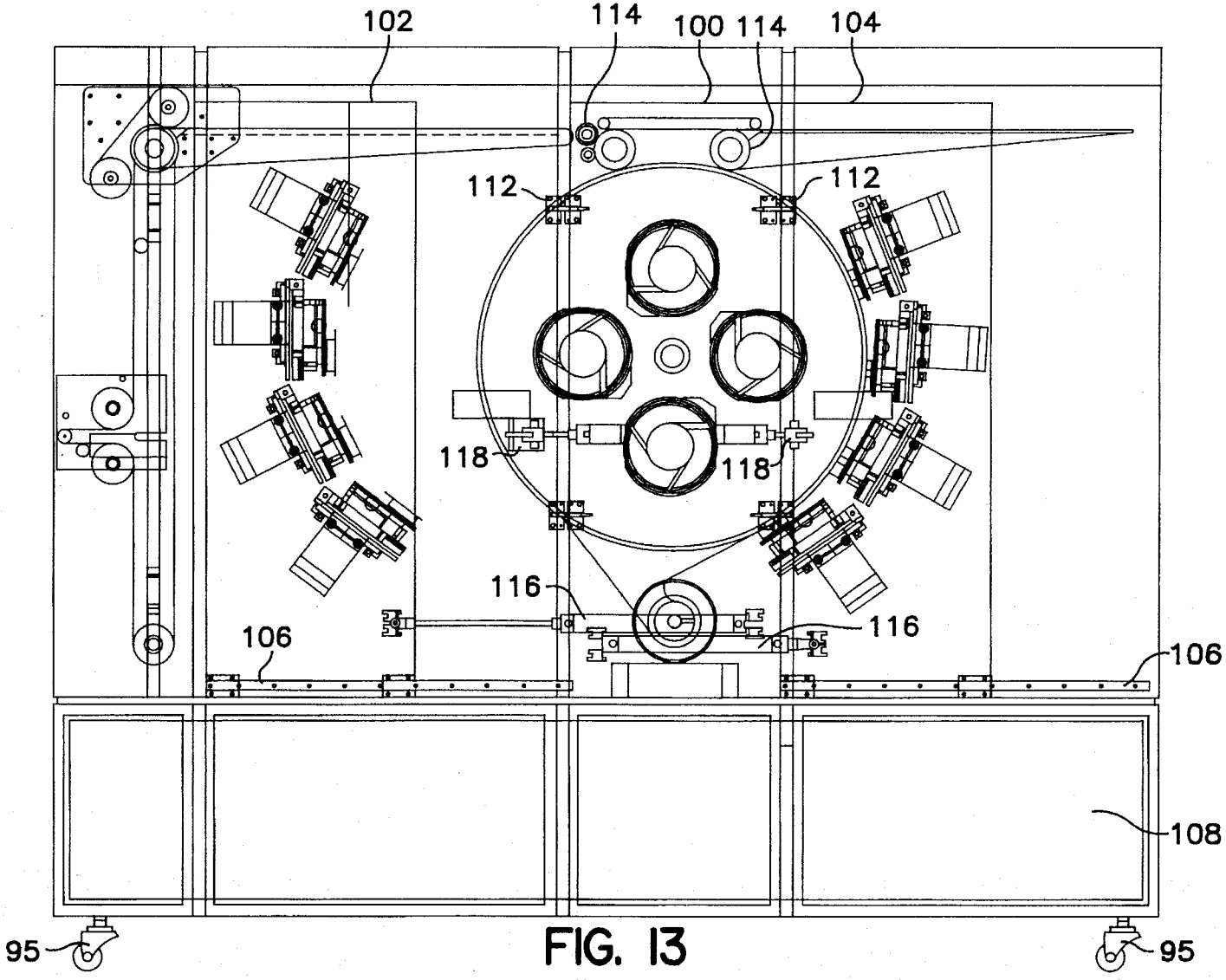
FIG. 13 is a partial schematic side elevation view of the apparatus of claim 2 wherein a frame section is extended.

The construction of the transport drum 80 may be seen from joint consideration of FIGS. 3, 11 and 12. The drum comprises a pair of end discs 82 and 84 and, if deemed necessary, an internal or central disc 86. A rigid "wrap" is supported by discs 82–86, this rigid wrap defining the porous cylinder 80. The drum or cylinder 80 is mounted for rotation about an axle 88, axle 88 thus defining the axis of rotation of the rotary transport. A plurality of fans 90 are supported on the end discs 82 and 84 of the rotary transport drum. The rotary transport drum is driven, via the main drive belt 68, by motor 92.

Proper performance of the document processing apparatus requires that the documents being processed be flatly adhered to and transported with the rotating drum 80. Additionally, it is important that the periphery of drum 80, in addition to being uniformly porous, be electrically inert, non-expanding and capable of withstanding moderately high temperature changes without loss of concentricity.

The fans 90 mounted within drum 80 exhaust to the outside of the drum thus creating a controllable and constant low pressure environment within the drum. The pressure level within drum 80 must be sufficient to cause a single document to adhere to the surface of the drum while, at the same time, the vacuum level should not impede the removal of selected pages from the drum, in the manner to be described below, even when substantially the entire outer periphery of the drum is covered. The vacuum level within drum 80 may be controlled in numerous ways such as, for example, by exercising control over the speed of fans 90.

Axle 88 is journalled and mounted onto the frame of the apparatus. The hollow shaft 88 functions as a conduit through which power and control signals may be delivered to the components which are mounted within drum 80. The ends of shaft 88 which protrude beyond the machine frame are equipped with rotary unions and various auxiliary devices, such as encoders, drive pulleys, commutators, etc. to permit adequate control, monitoring and power delivery.

All of the document processing functions are performed radially within the processing module at points which are equidistant from the axis of axle 88. In the apparatus, the processing module includes eight print heads 94. In one reduction to practice of the invention, each print head comprised ninety-six ink jets, i.e., each print head was capable of printing ninety-six pixels at a time. Within each print head, the jets were spaced by a distance of eight pixels. The print heads 94 are mounted, in the manner to be described below, so as to be axially moveable. If the disclosed embodiment with eight printer heads is considered to be a two accent color printer, a document adhered to drum 80 would be caused to make two passes and the printer heads would be stepped one pixel between passes. Each group of four printer heads would be employed to print a different color and, of course, the printer heads within each group would be axially offset from one another.

In the interest of facilitating access to the printing heads for service, the machine frame of the apparatus is divided into separable modules whereby the print heads on either side of the drum 80 may be retracted from the drum. Thus, the central transport which includes drum 80 is mounted on a first "tower" 100 and the two arrays of four printing heads, which are located on opposite sides of a vertical plane through the axis of rotation of drum 80 are respectively mounted on second 102 and third "towers" 104. Since the spacing of the print heads from the outer periphery of the drum 80 is critical, the towers which carry the print heads are mounted on precision slides of guide rails 106, thus assuring the return of the print heads, after opening of the apparatus for service, to their exact original position. To further ensure the exact relative positioning of all components of the system, regardless of temperature variations and external conditions such as the state of the floor on which the apparatus is supported, the towers are mounted on a common rigid base 108 which is supported on leveling jacks or castors 95 as required.

The "towers" 102, 104 on which the print heads 94 are mounted have oppositely disposed side plates 106. One side plate of each tower 108 is mounted for movement along a guide rail 106 which extends from the common base. The other side plate of each tower travels on eccentrically mounted rollers. This arrangement permits lateral creep and adjustments. Precise docking is assured through the use of docking pins 112 which are guided into receivers 114 under the influence of pneumatic actuators 116. The towers which support the print heads are latched to the tower which supports drum 80 by means of pneumatic latches.

For the precise docking of the frame towers 102 and 104 to the central tower 100, a latching mechanism is employed so as to keep the print heads 92 with the drum. The latching mechanism 118 has a first mount 120 fixed to the central tower 100 and a second mount 122 mounted to one of the slidable or moveable towers 102, 104. Fixed to mount 122 is a nipple 124. Fixed to mount 120 is a hydraulic cylinder 126 and two guide pins 128. Slidably mounted to the guide pins 128 is a collar 130.

Figure 14:
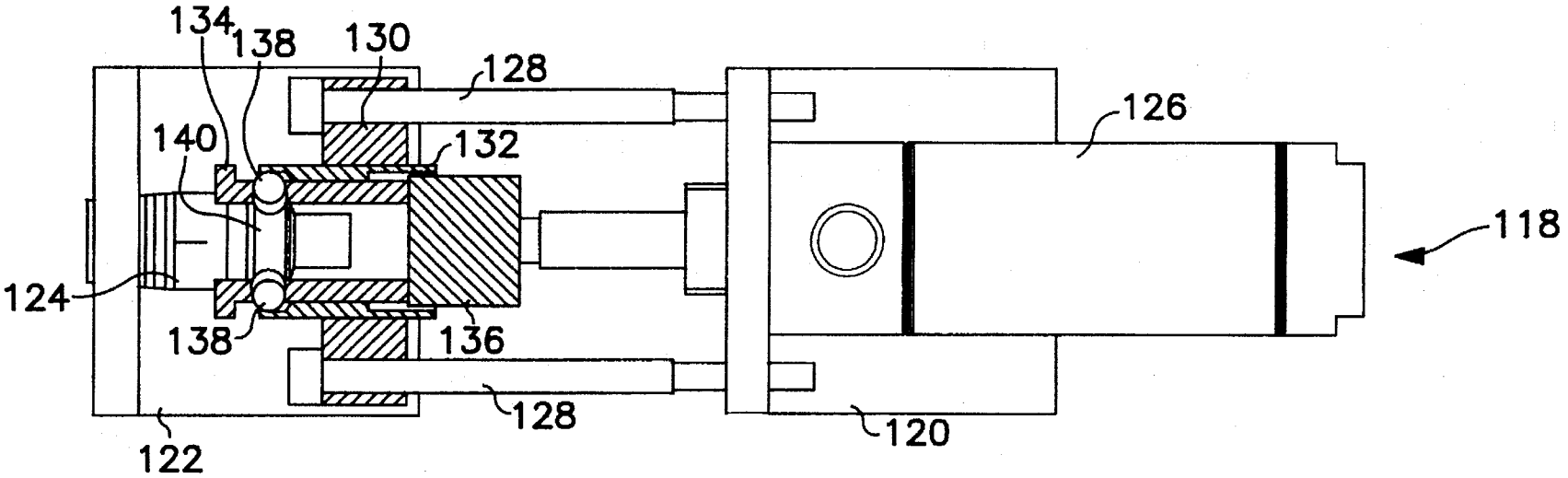
FIG. 14 is a partial schematic side view of the latching mechanism of FIG. 13 in an unlatched state.
Figure 15:
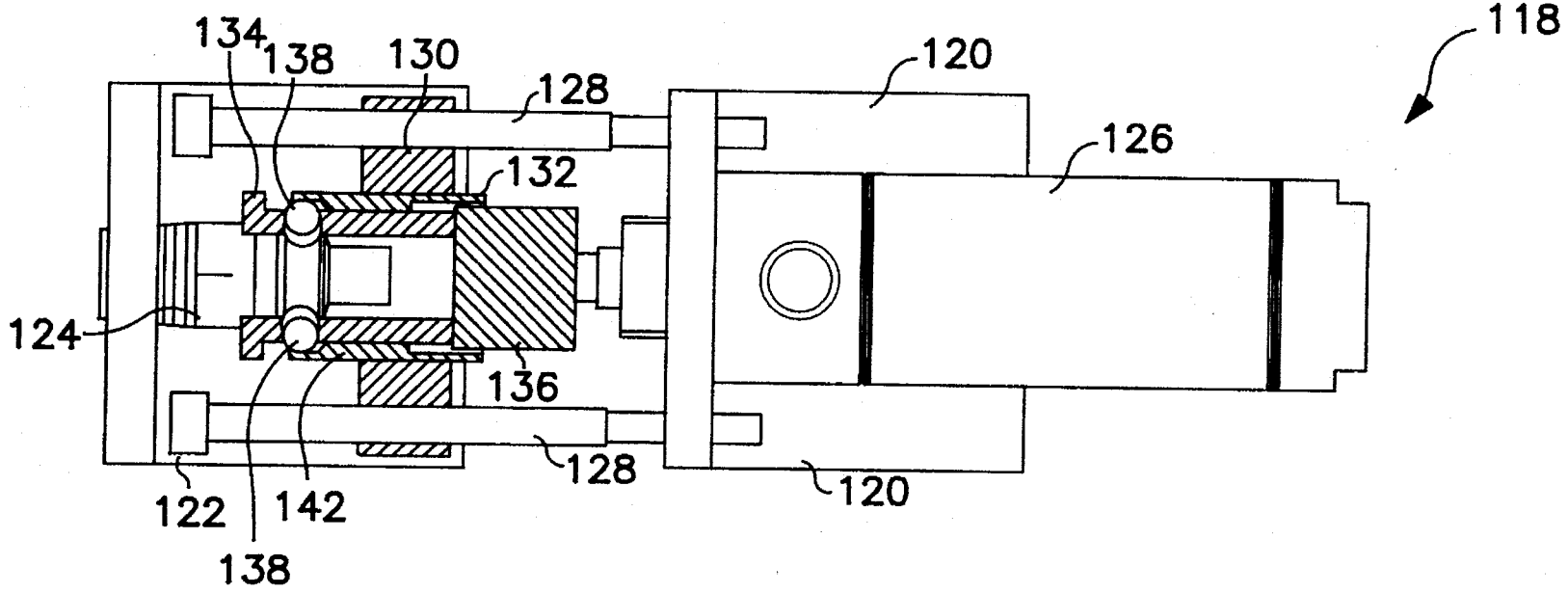
FIG. 15 is a partial schematic side view of the latching mechanism of FIG. 13 in a latched state.

FIG. 14 shows the nipple 124 beginning to engage with locking components 132. As shown in FIG. 14, the nipple engages shoulders on center sleeve 134 which is movably mounted to member 136. As mount 122 moves to mount 120, ball bearings 138 into groove 140 on nipple 124. The ball bearings are held into the position during the latching function in the groove by outer sleeve 142. Outer sleeve 142 is engaged by spring, not shown, with member 136. Disengagement of the latching mechanism 118 is accomplished by the movement of sleeve 142 to allow the ball bearings 138 to rise out of the groove 140 of nipple 124 thereby allowing the nipple and frame 122 to be released.

The print heads 92 are, as noted above, mounted on individual platforms which are supported for movement on parallel tracks. Movement is imparted to these platforms, in response to the operation of stepping motors, by backlashless acme screws. The tracks on which the platforms travel are oriented parallel to the axis of axle 88 and the drive arrangement ensures positioning of the platforms with a precision of ⅛ pixel. To assure perfect alignment and spacing of the nozzle array of each print head from the surface of drum 80, each platform may be adjusted in three mutually orthogonal directions. Additionally, rotational adjustment about the axis of one of the jets of each print head is possible.

A pick-off module is located at the level of the vacuum roll of the placement/bypass module. The function of the pick-off module is to selectively remove documents from drum 80 and redirect the removed documents onto an exit conveyor. The construction of the pick-off module is similar to that of the placement/bypass module, i.e., the pick-off module includes a porous cylinder 58' which surrounds a mandrel 66'. The force exerted on a document which is adhered to drum 80 by the pick-off module must be sufficiently great, i.e., the level of vacuum within the mandrel 66' must be sufficiently low, to cause the document to be separated from drum 80. The mandrel 66' will be rotated, such that suction will be applied in the paper path defined by drum 80 only when it is desired to pick-off a document. Thus, through exercising control over the rotation of mandrel 66', a document may be maintained on drum 80 so as to make as many passes as necessary past the print heads.

A document picked off drum 80 by the pick-off module will be delivered to a discharge module comprising a series of horizontally oriented, elastomeric belts 96 which are driven in synchronism with the outer porous cylinder 58' of the pick-off module. The belts will deliver the document to a downstream location, i.e., to the subsequent processing module, which may be a stacker, shingling conveyor or other post processing equipment.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. An edge justifying document conveyor comprising:

a first roller, said first roller defining a first axis of rotation;

a second roller, said second roller being spaced from said first roller and defining a second axis of rotation lying generally parallel to said first axis of rotation;

an endless conveyor belt, said belt extending between and around said first roller and said second roller whereby said belt defines an upper document transport path having an axis which extends between said rollers, said belt also having a lower return path between said rollers, said belt undergoing at least one twist about said transport path axis; and guide rail means for providing an edge guide for the justification of documents being conveyed by said belt along said transport path, said guide rail means extending generally perpendicular to said first axis of rotation, the twist in said belt causing documents being conveyed along said transport path to be moved angularly relative to said transport path axis into contact with said guide rail means.

2. An edge justifying document conveyor comprising:

a first roller, said first roller defining a first axis of rotation;

a second roller, said second roller being spaced from said first roller and defining a second axis of rotation lying generally parallel to said first axis of rotation;

guide rail means for providing an edge guide for the edge justifying of documents, said guide rail means limiting movement of documents presented thereto to a direction which is generally perpendicular to said first axis of rotation;

drive means for rotating at least one of said first and second rollers about its respective axis of rotation; and at least a first twisted elastomeric belt extending between and disposed around said first and second rollers, said twisted belt spiraling between said first and second rollers in response to rotation of said at least one roller to thereby impart movement to documents supported on said belt, said document movement including a component directed toward said guide rail means whereby the documents will move into contact with and subsequent travel along said guide rail means in the direction of belt travel between said rollers.

3. The edge justifying conveyor of claim 2 further comprising at least a second twisted belt parallelly disposed with respect to said first belt.

* * * * *